US011536516B2

(12) United States Patent
Sakamoto

(10) Patent No.: US 11,536,516 B2
(45) Date of Patent: Dec. 27, 2022

(54) HEAT-TREATING FURNACE

(71) Applicant: Hitoshi Sakamoto, Yoshikawa (JP)

(72) Inventor: Hitoshi Sakamoto, Yoshikawa (JP)

( * ) Notice: Subject to any disclaimer, the term of this patent is extended or adjusted under 35 U.S.C. 154(b) by 396 days.

(21) Appl. No.: 16/646,045

(22) PCT Filed: Sep. 13, 2017

(86) PCT No.: PCT/JP2017/033054
§ 371 (c)(1),
(2) Date: Mar. 10, 2020

(87) PCT Pub. No.: WO2019/053808
PCT Pub. Date: Mar. 21, 2019

(65) Prior Publication Data

US 2020/0278153 A1 Sep. 3, 2020

(51) Int. Cl.

| | |
|---|---|
| ***F27D 3/00*** | (2006.01) |
| ***F27B 9/02*** | (2006.01) |
| ***F27D 1/18*** | (2006.01) |
| ***C22F 1/04*** | (2006.01) |
| ***F27D 7/04*** | (2006.01) |
| *F27D 99/00* | (2010.01) |

(52) U.S. Cl.
CPC ..... *F27D 3/0024* (2013.01); *C22F 1/04* (2013.01); *F27B 9/028* (2013.01); *F27D 1/18* (2013.01); *F27D 1/1808* (2013.01); *F27D 7/04* (2013.01); *F27D 2003/0087* (2013.01); *F27D 2007/045* (2013.01); *F27D 2099/0093* (2013.01)

(58) Field of Classification Search
None
See application file for complete search history.

(56) References Cited

U.S. PATENT DOCUMENTS

| | | | | |
|---|---|---|---|---|
| 2008/0003534 | A1 | 1/2008 | Takano et al. | |
| 2014/0349240 | A1 | 11/2014 | Kajitani | |
| 2016/0223260 | A1 | 8/2016 | Iwane et al. | |
| 2016/0313061 | A1 | 10/2016 | Mandai et al. | |
| 2020/0278153 | A1* | 9/2020 | Sakamoto | F27D 1/1808 |

FOREIGN PATENT DOCUMENTS

| | | | |
|---|---|---|---|
| JP | H05-172464 | A | 7/1993 |
| JP | H11-016659 | A | 1/1999 |
| JP | 2004-257658 | A | 9/2004 |

(Continued)

*Primary Examiner* — Scott R Kastler
(74) *Attorney, Agent, or Firm* — Harness, Dickey & Pierce, P.L.C.

(57) ABSTRACT

A heat-treating furnace has: a rotary shaft; a rotary bottom surface pivotally supported by the rotary shaft and rotates; a plurality of workpiece storage chambers arranged on the rotary bottom surface in a multi-stage torus configuration around an axis of the rotary shaft as a center; a hollow bell-shaped hot-blast guide disposed in a center of the torus configuration on the rotary bottom surface around the axis of the rotary shaft as a center so as to decrease a volumetric capacity in the furnace and to adjust a quantity of a hot blast fed in from above itself into the workpiece storage chamber on each stage; a furnace body bottom surface spaced away from the rotary bottom surface; and a furnace body lateral surface disposed on the furnace body bottom surface.

8 Claims, 9 Drawing Sheets

(56) References Cited

FOREIGN PATENT DOCUMENTS

| | | | |
|---|---|---|---|
| JP | 2006-200823 | A | 8/2006 |
| JP | 2008-138916 | A | 6/2008 |
| JP | 2014-009879 | A | 1/2014 |
| JP | WO-2015-015563 | A1 | 2/2015 |
| JP | WO-2015-105026 | A1 | 7/2015 |
| WO | WO-2013-118261 | A1 | 8/2013 |

* cited by examiner

HEAT-TREATING FURNACE

CROSS REFERENCE TO RELATED APPLICATIONS

This application is a National Stage Application of PCT/JP2017/033054 filed on Sep. 13, 2017 and published in Japanese as WO2019/053808 on Mar. 21, 2019. The above application is hereby expressly incorporated by reference herein in its entirety.

BACKGROUND

Technical Field

The present invention relates to a heat-treating furnace having high thermal efficiency.

Related Art

Heating treatment for improving hardness of metal is known as an aluminum alloy actively used in various scenes as aircraft members, automobile wheels and the like, for example. The heating treatment of metal is performed by mainly using a furnace.

As types of furnaces for heating treatment of the aluminum alloy, for example, a hot-blast circulation type furnace is used for promoting stability of quality by bringing an in-furnace temperature close to uniform, or a multi-stage rotary hearth furnace is used for saving space of a heat-treatment facility. Moreover, there is a hot-blast circulation type multi-stage rotary hearth furnace combining these features.

Japanese Patent Laid-Open No. 2004-257658 is an example of the hot-blast circulation type multi-stage rotary hearth furnace, and in this hot-blast circulation type multi-stage rotary hearth furnace, a trajectory in a workpiece placing table of the hot blast warmed by a heat source is one way passing from below to above and thus, such a process is gone through that the stored workpieces are warmed in order from below to above. Thus, heat-treating conditions such as a temperature rising speed, a heat history and the like do not become equivalent, and the quality cannot be made stable easily. Moreover, in the case of the hot-blast circulation type furnace, an axial fan is mainly used in usual, but since an absolute air quantity is needed for uniform heating with high accuracy, the size of the axial fan becomes large, which is a problem.

Thus, in Japanese Patent Laid-Open No. 2008-138916, a hot-blast circulatory furnace having an object to provide a hot-blast circulation type multi-stage rotary hearth furnace which enables equal heat treating conditions of workpieces stored in each of the multi stages, efficient use of the air quantity of the axial fan, and uniform heating treatment with high accuracy is provided.

The hot-blast circulation furnace in Japanese Patent Laid-Open No. 2008-138916 is a hot-blast circulation furnace characterized by having a plurality of workpiece storage chambers arranged in a torus configuration, in which each of the workpiece storage chambers is configured such that the hot blast blown into the center of the torus configuration flows in from a center side of the torus configuration and is discharged to an outside of the torus configuration, a hot blast guide is provided in order to decrease the volumetric capacity in the furnace at the center of the torus configuration, and the hot-blast guide has an air-rectifying blade so that the hot blast is fed out to each of the workpiece storage chambers.

However, in Japanese Patent Laid-Open No. 2008-138916, although outstanding technical idea is disclosed, devises for thermal efficiency particularly for decreasing the heat escaping to an outside are not particularly present and thus, a problem has remained in the point of thermal efficiency.

SUMMARY

Thus, the invention of the present application has an object to provide a heat-treating furnace having high thermal efficiency.

More specifically, the present invention provides a heat-treating furnace having: a rotary shaft; a rotary bottom surface pivotally supported by the rotary shaft and rotates; a plurality of workpiece storage chambers arranged on the rotary bottom surface in a multi-stage torus configuration around an axis of the rotary shaft as a center; a hollow bell-shaped hot-blast guide disposed in a center of the torus configuration on the rotary bottom surface around the axis of the rotary shaft as a center so as to decrease a volumetric capacity in the furnace and to adjust a quantity of a hot blast fed in from above itself into the workpiece storage chamber on each stage; a furnace body bottom surface spaced away from the rotary bottom surface; and a furnace body lateral surface disposed on the furnace body bottom surface.

Subsequently, in addition to the aforementioned feature, a heat-treating furnace in which the furnace body bottom surface is configured to have a downward taper from the center toward an outer wall surface, and a dust discharge port is provided immediately below the outer wall surface.

Subsequently, in addition to the aforementioned feature, a heat-treating furnace in which an in-furnace inspection port is provided on the furnace body lateral surface in the vicinity of the furnace body bottom surface.

Lastly, in addition to the aforementioned feature, a heat-treating furnace is provided in which a workpiece insertion port and/or a workpiece take-out port provided in accordance with a height of each of the workpiece storage chambers on the furnace body lateral surface corresponding to the workpiece storage chambers in a vertical relation is disposed on the furnace body lateral surface so as not to come immediately above or below.

Effects of the Invention

By means of the heat-treating furnace having the configurations as above, the heat-treating furnace having high thermal efficiency can be provided.

BRIEF DESCRIPTION OF THE DRAWINGS

FIG. 8 is a view illustrating an example of a rotary shaft when glass fibers are mixed in between.

DETAILED DESCRIPTION

Hereinafter, embodiments for exploiting the present invention will be described. It should be noted that the present invention should not be interpreted by being limited to the embodiments described below.

Embodiment 1

A heat-treating furnace of this embodiment is a heat-treating furnace having the most basic configuration of the present invention and generally has a rotary shaft, a rotary bottom surface, a plurality of workpiece storage chambers disposed on the rotary bottom surface, a hollow bell-shaped hot-blast guide, a furnace body bottom surface spaced away from the rotary bottom surface, and a furnace body lateral surface disposed on the furnace body bottom surface.

Figure 1:
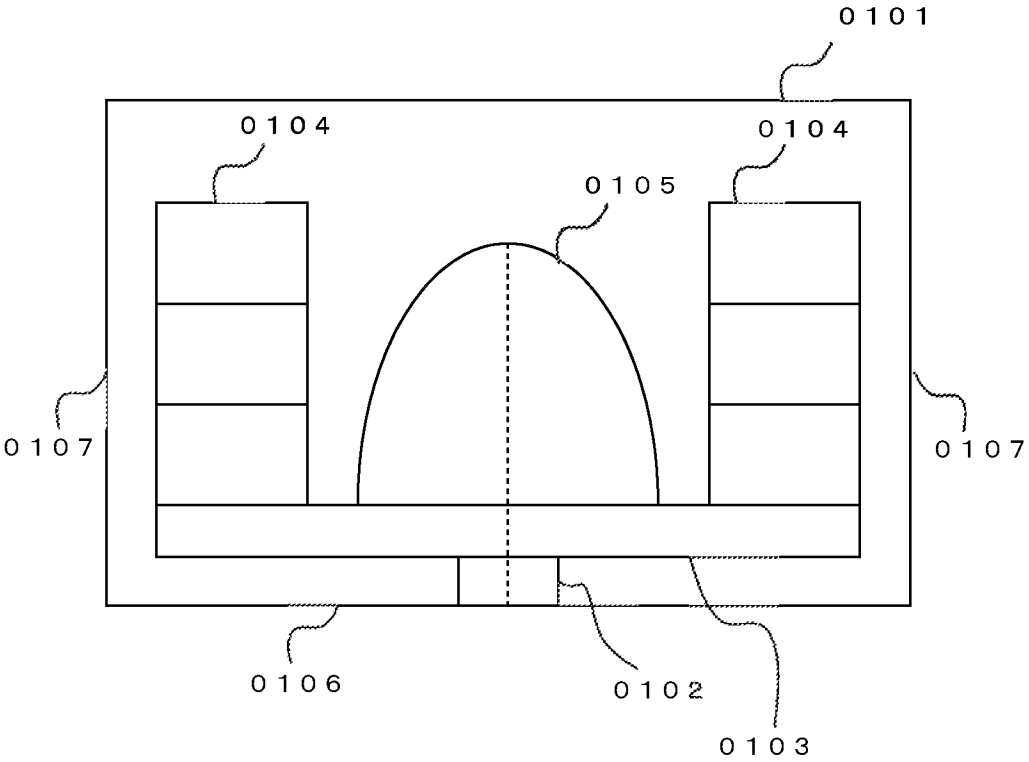
FIG. 1 is a view illustrating a concept of a heat-treating furnace in the present invention.

FIG. 1 is a view illustrating a concept of the heat-treating furnace in the present invention. The heat-treating furnace (0101) is composed of the rotary shaft (0102), the rotary bottom surface (0103), a plurality of the workpiece storage chambers (0104) disposed on the rotary bottom surface, the hollow bell-shaped hot-blast guide (0105), the furnace body bottom surface (0106) spaced away from the rotary bottom surface, and the furnace body lateral surface (0107) disposed on the furnace body bottom surface.

The "rotary shaft" is a shaft for rotating the rotary bottom surface. Moreover, it has a role not only of rotating the rotary bottom surface but also of supporting the rotary bottom surface/the hollow bell-shaped hot-blast guide/the plurality of workpiece storage chambers.

This rotary shaft preferably has sufficient strength for supporting the rotary bottom surface/the hollow bell-shaped hot-blast guide/the plurality of workpiece storage chambers from below, while if it is too large, a heat quantity transmitted to the furnace body bottom surface becomes too large and as a result, an emission amount of the heat to the outside increases, and the thermal efficiency lowers. Thus, the rotary bottom surface/the hollow bell-shaped hot-blast guide/the plurality of workpiece storage chambers are preferably arranged uniformly around the rotary shaft, and moreover, the size of the rotary shaft itself is preferably as small as possible.

A material of the rotary shaft is preferably a material with low heat conductivity or in a hollow state so that the thermal efficiency is not lowered. Specific examples of the material with low heat conductivity generally include stainless steel, ceramics, crystal, glass, polyethylene, epoxy resin, silicone, wood and the like and among them, stainless steel and ceramics are preferable as the material with excellent cost performance, high strength, and noninflammability. Moreover, the material of glass only does not have sufficient strength, but since glass has excellent thermal insulation and high compression strength, such devise can be considered that the heat conductivity of the entire rotary shaft is relatively lowered by mixing glass fibers in between.

Figure 8:
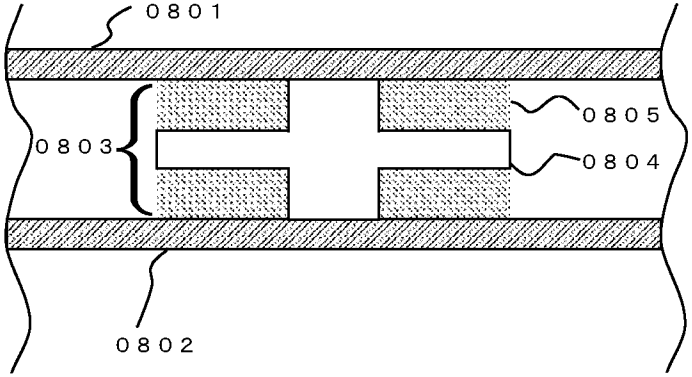

FIG. 8 is a view illustrating an example of the rotary shaft when the glass fibers are mixed in between. A rotary shaft (0803) is present between a rotary bottom surface (0801) and a furnace body bottom surface (0802), and the rotary shaft is configured by mixing glass fibers (0805) between basic materials (0804) such as stainless steel.

Figure 9:
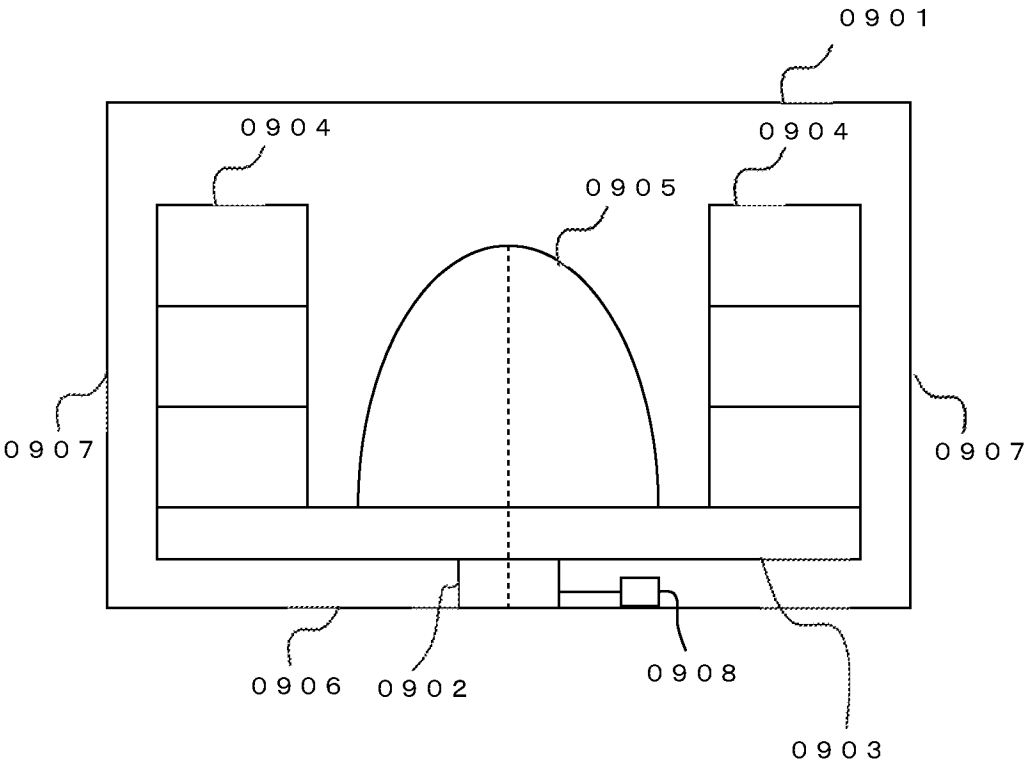
FIG. 9 is a view illustrating a concept of a heat-treating furnace in which a motor is provided.

Moreover, a motor for rotating the rotary shaft may be provided in the vicinity of the rotary shaft. FIG. 9 is a view illustrating a concept of the heat-treating furnace in which the motor is provided. A heat-treating furnace (0901) is composed of a rotary shaft (0902), the motor (0908) provided in the vicinity of the rotary shaft, a rotary bottom surface (0903), a plurality of workpiece storage chambers (0904) disposed on the rotary bottom surface, a hollow bell-shaped hot-blast guide (0905), a furnace body bottom surface (0906) spaced away from the rotary bottom surface, and a furnace body lateral surface (0907) disposed on the furnace body bottom surface.

Subsequently, the "rotary bottom surface" is a mechanism pivotally supported by the rotary shaft and rotates. This rotary bottom surface is also preferably configured by a material with low heat conductivity so that the thermal efficiency is not lowered.

Subsequently, the "plurality of workpiece storage chambers" is a mechanism disposed on the rotary bottom surface in the multi-stage torus configuration around the axis of the rotary shaft as a center.

Figure 2:
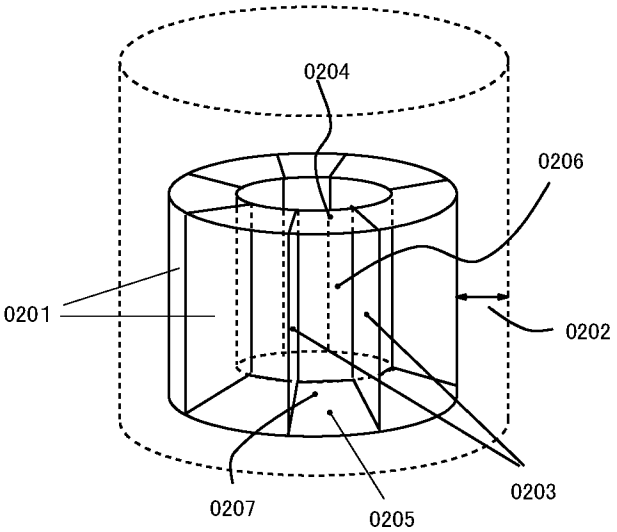
FIG. 2 is a view illustrating a concept of a workpiece storage chamber.

FIG. 2 is a view illustrating a concept of a part of the workpiece storage chamber. The workpiece storage chamber is a space (0201) for individually storing the workpiece and is disposed in the furnace in the torus configuration. Each of the workpiece storage chambers is partitioned by an intermediate partition plate (0203) with respect to a surface in the circumferential direction, while it is also partitioned by a storage-chamber ceiling (0204) and a storage base (0205) with respect to surfaces in the vertical direction. The hot blast does not pass in the circumferential direction and the vertical direction of the workpiece storage chamber since there are the intermediate partition plate/storage chamber ceiling/storage base, but since there is nothing to partition the space on an inner lateral surface (hereinafter referred to as an "inner surface": 0206) and an outer lateral surface (hereinafter referred to as an "outer surface": 0207) in the torus configuration, the hot blast can pass therethrough. The outer surface of the torus configuration and an in-furnace wall are not in contact, a certain space (0202) is present between them, and the hot blast can pass through the space.

Structures of the inner surface and the outer surface in the workpiece storage chamber only need to be configured such that air can blow through and may be partitioned by a partition plate having a hole or a meshed partition plate and the like, for example.

Figure 3:
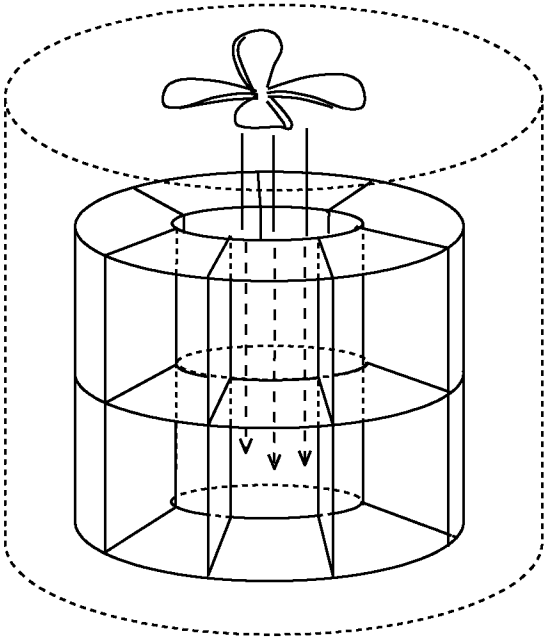
FIG. 3 is a view illustrating a concept of a plurality of the workpiece storage chambers.

FIG. 3 is a view illustrating a concept of a plurality of workpiece storage chambers. The workpiece storage chambers can be stacked in the vertical direction, and the number of stages to be stacked is not particularly limited but approximately 3 stages to 4 stages are preferable in view of workability and the space of a facility in which the furnace is disposed.

Subsequently, the "hollow bell-shaped hot-blast guide" refers to a hot-blast guide disposed in a center of the torus configuration on the rotary bottom surface around around the axis of the rotary shaft as a center so as to decrease a volumetric capacity in the furnace and to adjust a quantity of a hot blast fed in from above itself into the workpiece storage chamber on each stage, wherein the hot-blast guide has a hollow bell shape. Since it is hollow, the heat conductivity can be kept low, and the heat leaking out through the hot-blast guide and the rotary shaft can be decreased.

Moreover, by having the bell shape, the hot blast can be fed into each of the workpiece storage chambers equivalently.

Furthermore, with regard to the contents of the bell shape, the bottom surface portion of the bell shape preferably has a large diameter. When the diameter is large, a heat movement distance from a portion in contact with the rotary bottom surface of the hot blast to the rotary shaft can be made longer and moreover, since the inside of the bell-shaped guide is hollow and filled with air, which lowers the heat conductivity, the degree of heat leakage to the outside through the rotary shaft can be further lowered.

Subsequently, the "furnace body bottom surface" is a portion corresponding to a bottom surface of the entire heat-treating surface spaced away from the rotary bottom surface. Since the furnace body bottom surface is spaced away from the rotary bottom surface, the heat movement from the rotary bottom surface to the furnace body bottom surface can be limited only on the rotary shaft. In order to prevent heat radiation from the rotary bottom surface so as to further improve the thermal efficiency, a substance with high thermal insulation performance such as glass fibers, for example, is preferably disposed along the lower surface of the rotary bottom surface.

Subsequently, the "furnace body lateral surface" is a portion corresponding to a lateral surface of the entire heat-treating furnace disposed on the furnace body bottom surface. Since the furnace body lateral surface is present, the hot blast can be discharged in a concentrated manner from a part of the furnace body. The furnace body lateral surface is preferably close to the outer surface of the workpiece storage chamber. If they are close to each other, the hot blast coming from the outer surface of the workpiece storage chamber can be prevented from leaking through a space between the workpiece storage chamber and the furnace body lateral surface to the furnace body bottom surface side, for example, or from heating the motor located on the furnace body bottom surface. It is preferable also in the meaning that conduction of the heat to the motor is prevented since efficiency of the motor can be lowered by an influence of the heat when rotation is performed by a magnetic force.

The shape of the heat-treating furnace is preferably columnar, and in that case, the shape when seen from the furnace body bottom surface and the furnace body upper surface is circular, and the shape when seen from the lateral surface is cylinder.

Moreover, the rotary bottom surface is preferably configured to have a downward taper from a contact point between the bell-shaped hot-blast guide and the rotary bottom surface toward the workpiece storage chamber. As a result, dusts can be made to fall onto the furnace body bottom surface.

Figure 4:
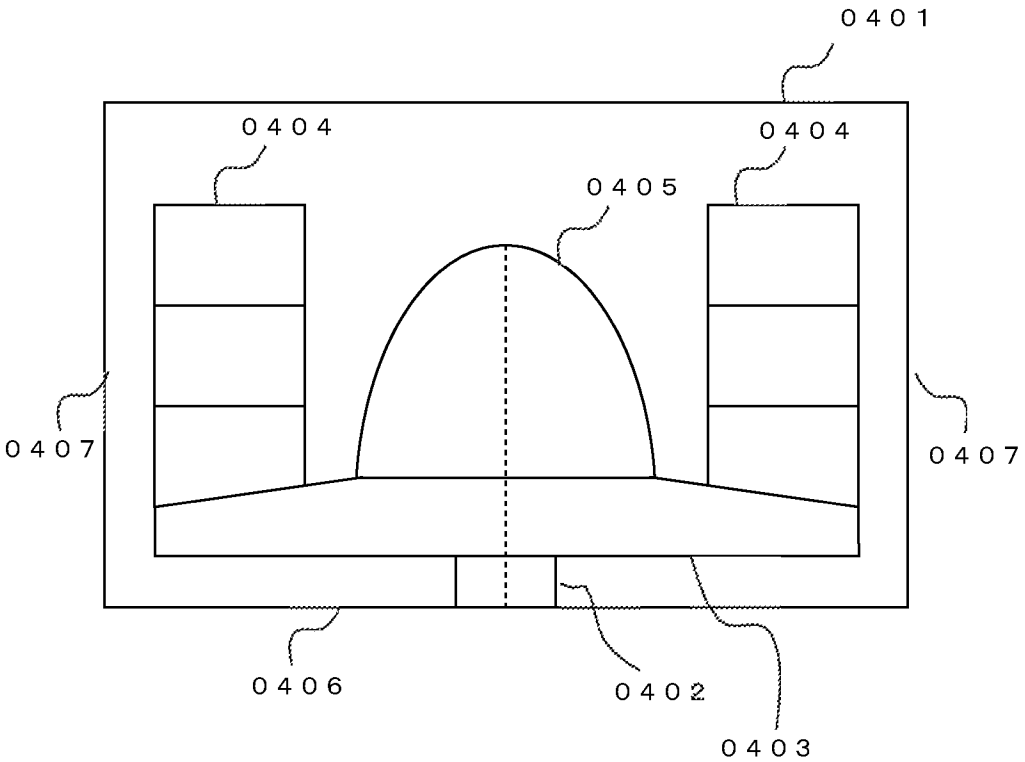
FIG. 4 is a view illustrating a concept when a rotary bottom surface is configured to have a downward taper from the center toward the workpiece storage chamber.

FIG. 4 is a view illustrating a concept when the rotary bottom surface is configured to have a downward taper from the center toward the workpiece storage chamber. A heat-treating furnace (0401) is composed of a rotary shaft (0402), a rotary bottom surface (0403), a plurality of workpiece storage chambers (0404) disposed on the rotary bottom surface, a hollow bell-shaped hot-blast guide (0405), a furnace body bottom surface (0406) spaced away from the rotary bottom surface, and a furnace body lateral surface (0407) disposed on the furnace body bottom surface, and the rotary bottom surface (0403) is configured to have a downward taper from the center toward the workpiece storage chamber.

By means of the heat-treating furnace having the configuration as above, the heat-treating furnace having high thermal efficiency can be provided.

Embodiment 2

The heat-treating furnace of this embodiment is, in addition to the features described in Embodiment 1, characterized in that the furnace body bottom surface is configured to have a downward taper from the center toward the outer wall surface, and a dust discharge port is provided immediately below the outer wall.

Figure 5:
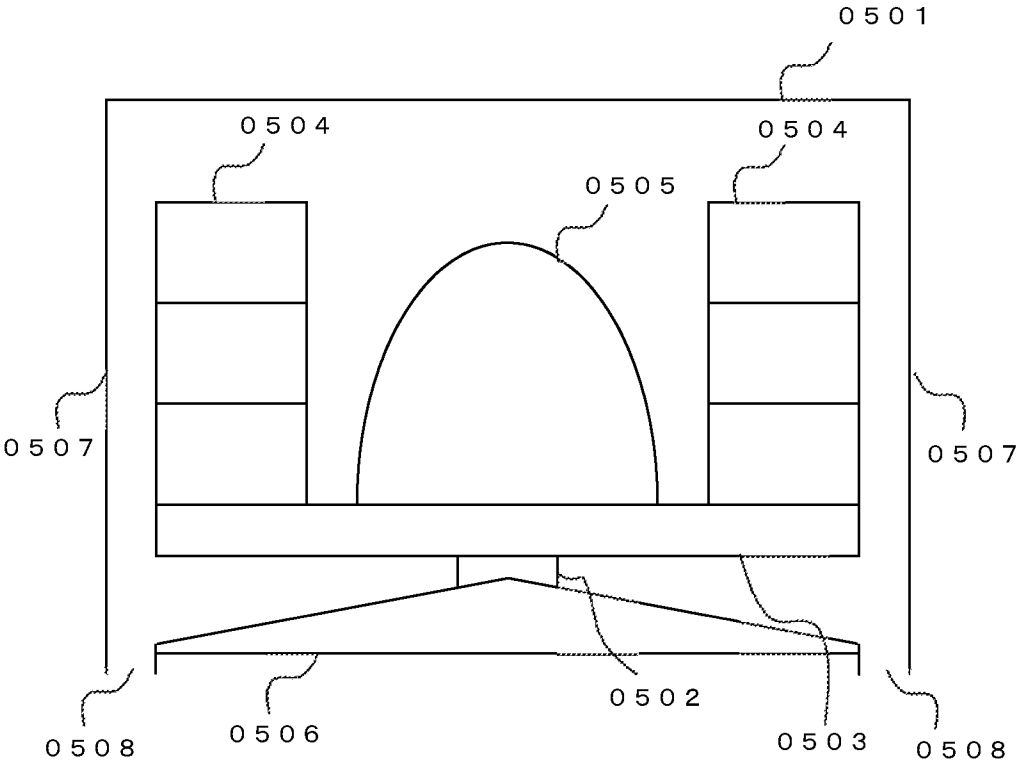
FIG. 5 is a view illustrating a concept of a heat-treating furnace in Embodiment 2.

FIG. 5 is a view illustrating a concept of a heat-treating furnace in this embodiment. The heat-treating furnace (0501) is composed of a rotary shaft (0502), a rotary bottom surface (0503), a plurality of workpiece storage chambers (0504) disposed on the rotary bottom surface, a hollow bell-shaped hot-blast guide (0505), a furnace body bottom surface (0506) spaced away from the rotary bottom surface, and a furnace body lateral surface (0507) disposed on the furnace body bottom surface. The rotary bottom surface (0506) is configured to have a downward taper from the center toward the outer wall surface, and a dust discharge port (0508) is provided immediately below the outer wall surface.

Moreover, a devise may be provided on the rotary shaft for sending out air along the surface of the furnace body bottom surface from the rotary shaft toward the outer wall surface. Specific examples of the devise include configuration in which a blade is provided on the rotary shaft so that downward air is generated with rotation of the rotary shaft and configuration in which a hole is opened in the rotary bottom surface so as to communicate with the rotary shaft and to send out the air from the rotary bottom surface through the rotary shaft. By means of them, dusts can be efficiently moved from the center toward the outer wall surface.

By means of the configuration as above, collection of dusts in the heat-treating furnace can be prevented, heat radiation by the influence of the dusts can be prevented, and the thermal efficiency can be kept high.

Embodiment 3

A heat-treating furnace of this embodiment is a heat-treating furnace characterized in that, in addition to the features of Embodiment 1 or Embodiment 2, an in-furnace inspection port is provided on the furnace body lateral surface in the vicinity of the furnace body bottom surface.

Figure 6:
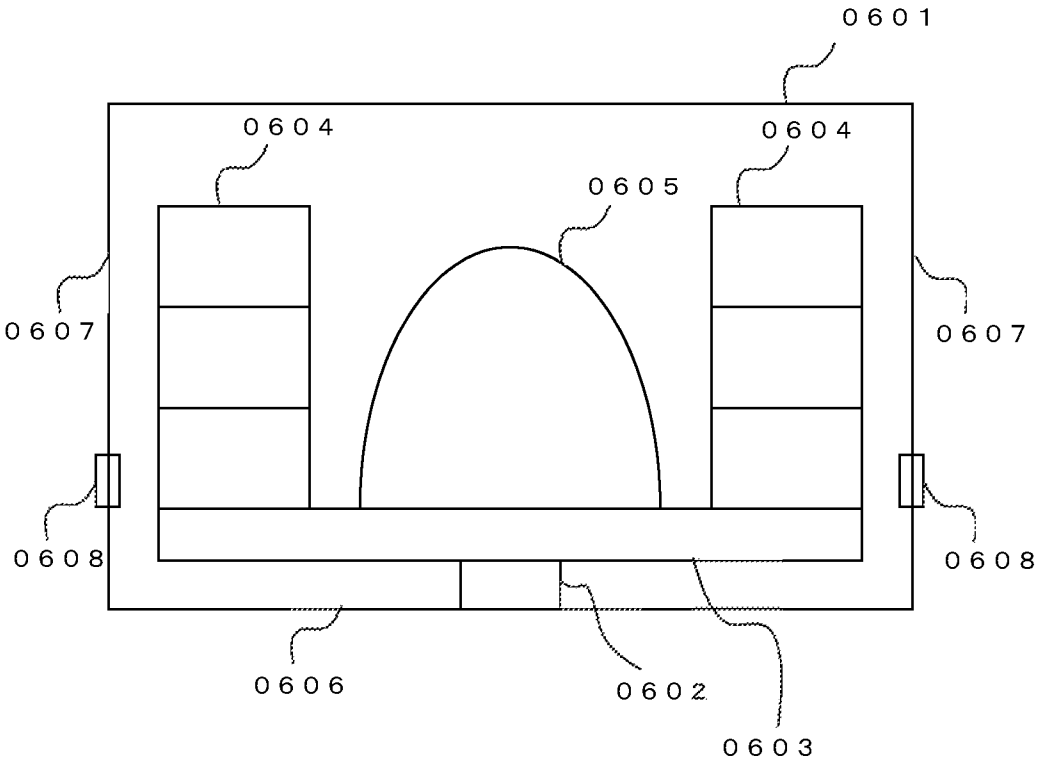
FIG. 6 is a view illustrating a concept of a heat-treating furnace in Embodiment 3.

FIG. 6 is a view illustrating a concept of a heat-treating furnace in this embodiment. The heat-treating furnace (0601) is configured by a rotary shaft (0602), a rotary bottom surface (0603), a plurality of workpiece storage chambers (0604) disposed on the rotary bottom surface, a hollow bell-shaped hot-blast guide (0605), a furnace body bottom surface (0606) spaced away from the rotary bottom surface, and a furnace body lateral surface (0607) disposed on the furnace body bottom surface. And the in-furnace inspection port (0608) is provided on the furnace body lateral surface in the vicinity of the furnace body bottom surface.

Moreover, the furnace body inspection port may have an opening/closing structure so that the inside of the furnace can be observed only at inspection but the heat is not allowed to escape other than at the inspection. Alternatively, the furnace body inspection port may be composed of a transparent member only for that portion so that the inside of the heat-treating furnace can be observed from the outside of the heat-treating furnace without allowing the heat to leak to the outside. By means of these devises, the inside of the heat-treating furnace can be inspected without lowering the thermal efficiency.

Moreover, by watching a surface color of the bell-shaped hot-blast guide through the in-furnace inspection port by using an infrared camera, an in-furnace temperature can be also measured.

By means of the configuration as above, inspection of the inside of the heat-treating furnace is facilitated, and failure prevention and regular maintenance of the heat-treating furnace can be made easy.

Embodiment 4

A heat-treating furnace of this embodiment is a heat-treating furnace characterized in that, in addition to the features of any one of the Embodiment 1 to Embodiment 3, a workpiece insertion port and/or a workpiece take-out port provided in accordance with the height of each of the workpiece storage chambers on the furnace body lateral surface and corresponding to the workpiece storage chamber in the vertical relation is disposed so as not to come immediately above or immediately below the furnace body lateral surface.

Figure 7:
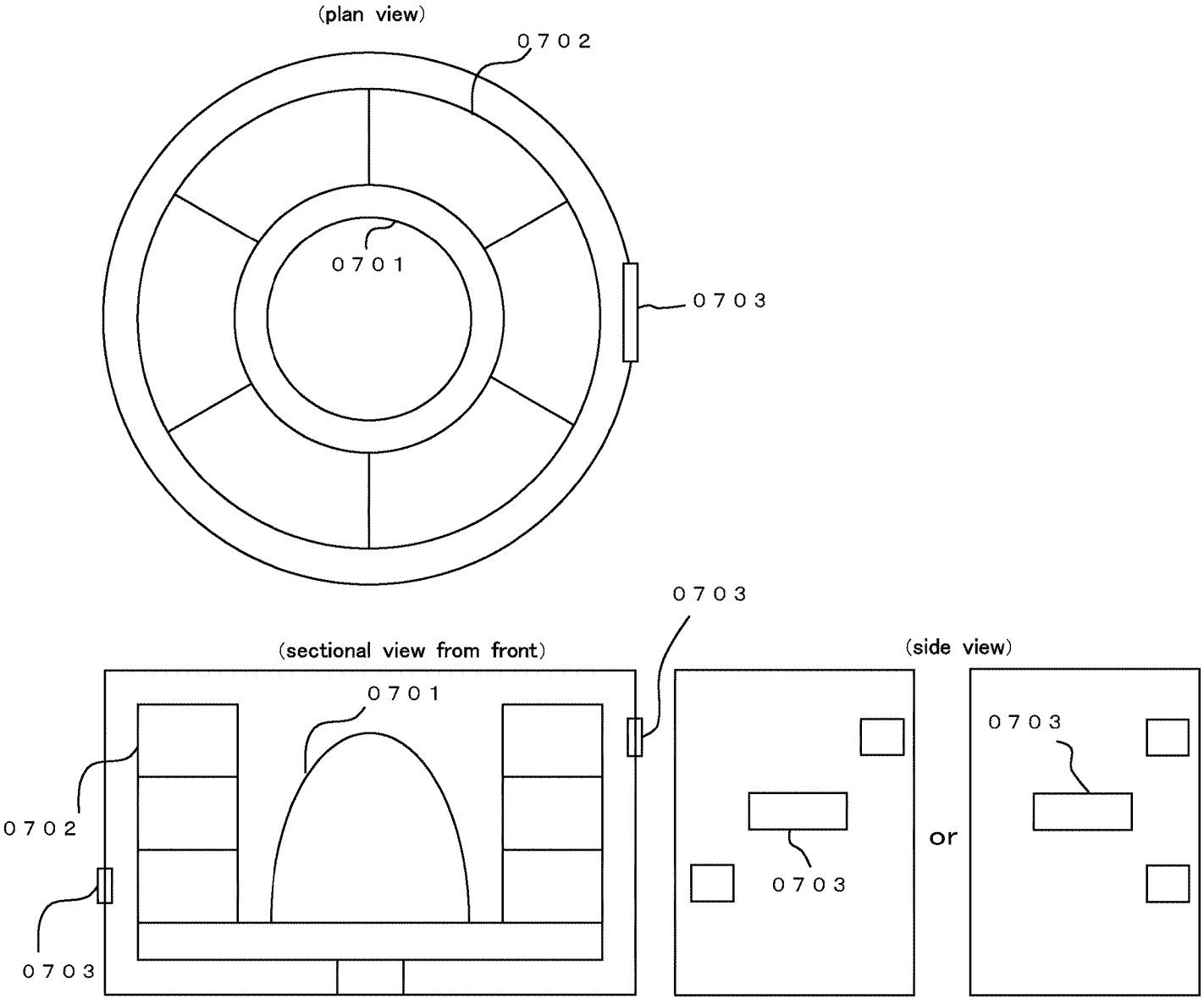
FIG. 7 are views illustrating a concept of a heat-treating furnace in Embodiment 4.

FIG. 7 are views illustrating a concept of the heat-treating furnace in Embodiment 4. They are (1) a plan view of the heat-treating furnace when seen from above; (2) a sectional view from front; and (3) a side view. In the (1) plan view, it can be seen that workpiece storage chambers (0702) are located around a hollow bell-shaped hot-blast guide (0701), and there is a workpiece insertion port (0703). In the (2) sectional view from the front, it can be seen that the workpiece storage chambers (0702) are located around the hollow bell-shaped hot-blast guide (0701), and there is the workpiece insertion port provided in accordance with the height of each of the workpiece storage chambers on the furnace body lateral surface. In the (3) side view, it can be seen that the workpiece insertion port and/or workpiece take-out port (0703) corresponding to the workpiece storage chamber in the vertical relation is disposed so as not to come immediately above or immediately below on the furnace body lateral surface. It is only necessary that the workpiece insertion port and/or workpiece take-out port does not come immediately above or immediately below, and when seen from the lateral surface, for example, disposition may be any one of left/center/right in order from above, left/center/left in order from above, left/right/left in order from above, right/left/center in order from above or any other dispositions. However, it is further preferable that they are not overlapped vertically even if it is not immediately above or immediately below in the meaning of preventing escape of the heat at a time.

By means of the configuration above, heat can be prevented from escaping at a time, and the thermal efficiency can be improved.

The invention claimed is:

1. A heat-treating furnace having:

a rotary shaft;

a rotary bottom surface, the rotary bottom surface being pivotally supported by the rotary shaft and rotating;

a plurality of workpiece storage chambers arranged on the rotary bottom surface in a multi-stage torus configuration around an axis of the rotary shaft as a center;

a hollow bell-shaped hot-blast guide disposed in a center of the torus configuration on the rotary bottom surface around the axis of the rotary shaft as a center so as to decrease a volumetric capacity in the furnace and to adjust a quantity of a hot blast fed in from above the hollow bell-shaped hot-blast guide into the workpiece storage chamber on each stage;

a furnace body bottom surface spaced away from the rotary bottom surface; and a furnace body lateral surface disposed on the furnace body bottom surface, wherein the furnace body bottom surface is configured to have a downward taper from the rotary shaft toward an outer wall surface, and a dust discharge port is provided immediately below the outer wall surface.

2. The heat-treating furnace according to claim 1, wherein the rotary bottom surface is configured to have a downward taper from a center toward a periphery of the rotary bottom surface.

3. The heat-treating furnace according to claim 1, wherein an in-furnace inspection port is provided on the furnace body lateral surface in a vicinity of the furnace body bottom surface.

4. The heat-treating furnace according to claim 1, wherein a plurality of workpiece insertion and/or take-out ports provided in the furnace body lateral surface, a height of each of the plurality of workpiece insertion and/or take-out ports corresponds to a height of each of the plurality of workpiece storage chambers along a vertical direction parallel to the axis of the rotary shaft, and adjacent two ports of the plurality of workpiece insertion and/or take-out ports do not align along the vertical direction.

5. The heat-treating furnace according to claim 2, wherein an in-furnace inspection port is provided on the furnace body lateral surface in a vicinity of the furnace body bottom surface.

6. The heat-treating furnace according to claim 2, wherein a plurality of workpiece insertion and/or take-out ports provided in the furnace body lateral surface, a height of each of the plurality of workpiece insertion and/or take-out ports corresponds to a height of each of the plurality of workpiece storage chambers along a vertical direction parallel to the axis of the rotary shaft, and adjacent two ports of the plurality of workpiece insertion and/or take-out ports do not align along the vertical direction.

7. The heat-treating furnace according to claim 3, wherein a plurality of workpiece insertion and/or take-out ports provided in the furnace body lateral surface, a height of each of the plurality of workpiece insertion and/or take-out ports corresponds to a height of each of the plurality of workpiece storage chambers along a vertical direction parallel to the axis of the rotary shaft, and adjacent two ports of the plurality of workpiece insertion and/or take-out ports do not align along the vertical direction.

8. The heat-treating furnace according to claim 5, wherein a plurality of workpiece insertion and/or take-out ports provided in the furnace body lateral surface, a height of each of the plurality of workpiece insertion and/or take-out ports corresponds to a height of each of the plurality of workpiece storage chambers along a vertical direction parallel to the axis of the rotary shaft, and adjacent two ports of the plurality of workpiece insertion and/or take-out ports do not align along the vertical direction.

* * * * *